United States Patent [19]

Schimko et al.

[11] Patent Number: 4,502,300

[45] Date of Patent: Mar. 5, 1985

[54] TENSION ADJUSTING DEVICE FOR FLAT KNITTING MACHINES

[75] Inventors: Reinhold Schimko, Aalen-Wasseralfingen; Franz Radl, Westhausen; Max Fuchs, Ellwangen, all of Fed. Rep. of Germany

[73] Assignee: Universal Maschinenfabrik Dr. Rudolf Schieber GmbH & Co. KG, Westhausen, Fed. Rep. of Germany

[21] Appl. No.: 559,075

[22] Filed: Dec. 7, 1983

[30] Foreign Application Priority Data

Dec. 7, 1983 [DE] Fed. Rep. of Germany ..... 3245230

[51] Int. Cl.[3] ..... D04B 7/00

[52] U.S. Cl. ..... 66/71; 66/78; 66/77

[58] Field of Search ..... 66/71, 78, 75.2, 77

[56] References Cited

U.S. PATENT DOCUMENTS 2,165,077 7/1939 Sordick ..... 66/71
2,183,719 12/1939 Lippman et al. ..... 66/71
3,035,426 5/1962 MacQueen ..... 66/75.2
3,771,329 11/1973 Krause ..... 66/78
3,779,044 12/1973 Schieber ..... 66/78

FOREIGN PATENT DOCUMENTS 2622883 12/1976 Fed. Rep. of Germany ..... 66/78

*Primary Examiner*—Ronald Feldbaum
*Attorney, Agent, or Firm*—Sughrue, Mion, Zinn, Macpeak, and Seas

[57] ABSTRACT

A flat knitting machine includes a device for adjusting the retractor elements for the needles in the cam systems on the carriage of the machine for the setting of the stitch tension. In order to simplify the tension adjusting mechanism and simultaneously to produce a sensitive setting mechanism, there is provided on the carriage a single electrical stepping motor, with position sensor, for counterbalanced adjustment of the leading and of the trailing retractor elements of each cam system.

11 Claims, 4 Drawing Figures

TENSION ADJUSTING DEVICE FOR FLAT KNITTING MACHINES

FIELD OF THE INVENTION

This invention relates to a device for adjusting the retraction or withdrawal depth for the needles in the cam systems on the carriage of a flat knitting machine for setting the stitch tension by means of electrical stepping motors.

DESCRIPTION OF THE PRIOR ART

Mechanical tension adjusting devices are well-known and widely used. They are based upon indexing bars on which a plurality of small index plates are fastened for the left and right retractor elements of a cam system. These small index plates have the object of bringing the retractor elements into the positions necessary for the required stitch tension by means of tilting levers or sliding elements. In connection with this it is particularly to be noted that the leading retractor elements always have to be raised up to or beyond the level-cams position, in order that the needles are not retracted uselessly, with the stitches consequently being subjected to additional strain. If a leading retractor element is positioned below the level-cams position, then a springing of the needles can also occur, and this can for its part lead to the needles breaking. In addition to the indexing bars for the adjustment of tension, separately functioning pendulum bars are provided which are switched over at each reversal of the carriage and raise the leading retractor element automatically into or above the level-cams position.

One device of the type first referred to above, in which the sensitive adjustment of the individual retractor elements is effected by means of respective electrical stepping motors, is described in German published patent application DE-OS No. 2111553.

It is also known from U.S. patent specification No. 2183719 to provide a device for the mechanical adjustment of the retractor elements using lever mechanisms on the carriage and ramp runners on the knitting machine frame, by means of which the retractor elements of a links+links flat knitting machine which overlie one another can be adjusted mechanically in the same direction by racks with intermediate pinions using a single ramp runner.

SUMMARY OF THE INVENTION

It is an object of the present invention to provide a tension adjusting device of the type first referred to above which is simpler than the known tension adjusting mechanisms, which has a more reliable construction, and which makes possible a very simple, coordinated counterbalanced setting of the leading and trailing retractor elements of each cam system.

This object is achieved in accordance with the present invention in that there is provided, on the carriage, a single stepping motor for counterbalanced adjustment of the leading and of the trailing retractor element of each cam system, a position sensor on the stepping motor, pinion means connected for fixed rotation with the stepping motor, and two rack means, said pinion means being in counterbalanced meshing engagement with said two rack means, one of said rack means being connected to one of the retractor elements and the other rack means being connected to the other retractor element.

With this mechanism the two retractor elements of a cam system, which are connected directly to the stepping motor, are respectively moved automatically in one or the other direction as soon as a setting of the trailing retractor element takes place. There is no need for a mechanical pendular elevation of the leading retractor element or to provide the pendulum bar previously needed for this.

Preferably, the connection of the pinion means for fixed rotation with the stepping motor is a releasable connection, in order to make it possible to carry out an accurate determination of the zero position of the stepping motor for the basic position of the two retractor elements. This produces a particularly simple structural arrangement for the tension adjusting device.

Preferably, the retractor elements are mounted on the carriage by means of guide grooves and guide blocks with an upper stop position for the basic position of each retractor element, while the rack means are releasably linked to the retractor elements by means of stops provided on the retractor elements. The retractor elements are desirably connected resiliently to each other by means of a spring which is tensioned around a guide roller. With this construction, the leading retractor element, in the adjustment of the trailing retractor element into the desired retracted position, is only raised into the basic position corresponding to the level-cams position, and, in this position, performs an additional protective and guiding role for the needles. The two rack means, because of their engagement with the pinion means which is connected for fixed rotation with the stepping motor, always perform their lengthwise movements through a common distance.

The stepping motor preferably includes an electromagnetic brake which is constructed so that the output-side end of the shaft of the stepping motor is held braked in its then adopted position when the brake is without energising current. In this way one can hold the stepping motor reliably in position under spring pressure during the knitting operation, with the brake only being supplied with energising current for so long as the stepping motor is adjusting the retractor elements at the positions of carriage reversal.

The stepping motor preferably includes an annular scale connected to a switch finger of its position sensor, this scale preferably being a vernier scale. From this annular scale one can get an accurate reading and monitor the current set retraction depth of the trailing retractor element in a simple manner.

The position sensor can be an inductive, capacitive or optical sensor.

The position sensor is preferably connected to an electronic circuit which monitors the basic position of the retractor elements at each passage of the stepping motor through its zero position and is arranged to switch the knitting machine off in the event of a departure from the basic position. A simpler adjustment of the stepping motor could hardly be hoped for.

DESCRIPTION OF THE DRAWINGS

In order that the invention may be fully understood a preferred embodiment of tension adjusting device in accordance with the invention will now be described in detail by way of example and with reference to the drawings. In the drawings.

DESCRIPTION OF THE PREFERRED EMBODIMENT

Figure 1:
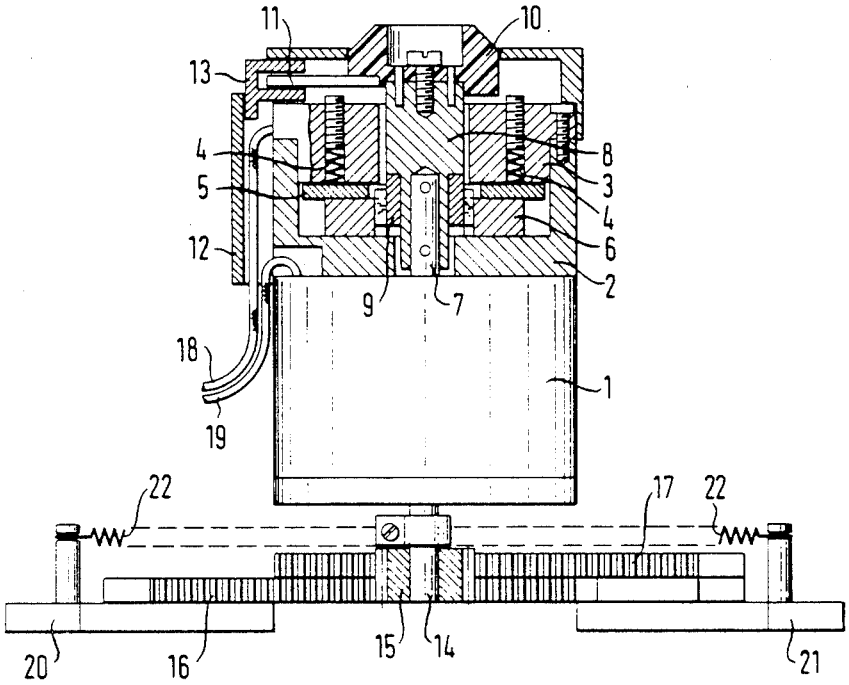
FIG. 1 is a side view, partly in section, of a tension adjusting device in accordance with the invention and comprising a stepping motor in engagement with two retractor elements.
Figure 2:
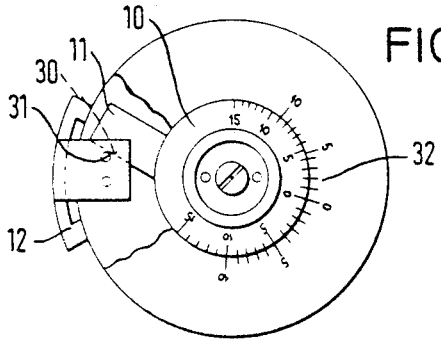
FIG. 2 is a top plan view of the device shown in FIG. 1.

The tension adjusting device shown in FIGS. 1 and 2 comprises a stepping motor 1 onto which a cup-shaped sleeve 2 is fitted by a screw fastening. Within the sleeve 2 there is mounted an electromagnetic brake 3 which, in the absence of energising current, causes a braking of the stepping motor 1 by the effect of the spring pressure of compression springs 4. The compression springs 4 exert pressure on a disc 5 on a brake disc 6, and this latter disc rests on the base of the cup-shaped sleeve 2.

The upper end 7 of a shaft which extends through the stepping motor 1 is pinned to a transmission sleeve 8 and to a toothed coupling ring 9. The braking disc 6 moves axially on the teeth of the coupling ring 9.

At the upper end of the transmission sleeve 8 a graduated ring 10 which forms an annular scale is centrally screwed and pinned. A switch finger 11 is secured to the graduated ring 10. By means of a support 12 which is fastened, for example by a screw fitting, on to the circumferential face of the sleeve 2, a position sensor 13, which overlaps the switch finger 11 in an interdigitated manner, is connected rigidly to the sleeve 2 and thus is fixed rigidly to the stepping motor 1. The position sensor 13 can be an inductive sensor, a capacitive sensor or an optical sensor.

When the brake is without energising current the upper end 7 of the shaft of the stepping motor 1 is clamped mechanically by the brake 3 by means of the compression springs 4, so that as a result the adopted position of the stepping motor 1 is fixed. The lower, i.e. output, end 14 of the stepping motor shaft is clamped to a pinion 15 by means of a screw fastening. This pinion 15 meshes with two toothed racks 16 and 17 which for their part are arranged to be engageable with the two retractor elements 20 and 21 respectively of a cam system. The electrical leads to the electromagnetic brake 3 and to the stepping motor 1 are indicated in FIG. 1 at 18 and 19.

Figure 3:
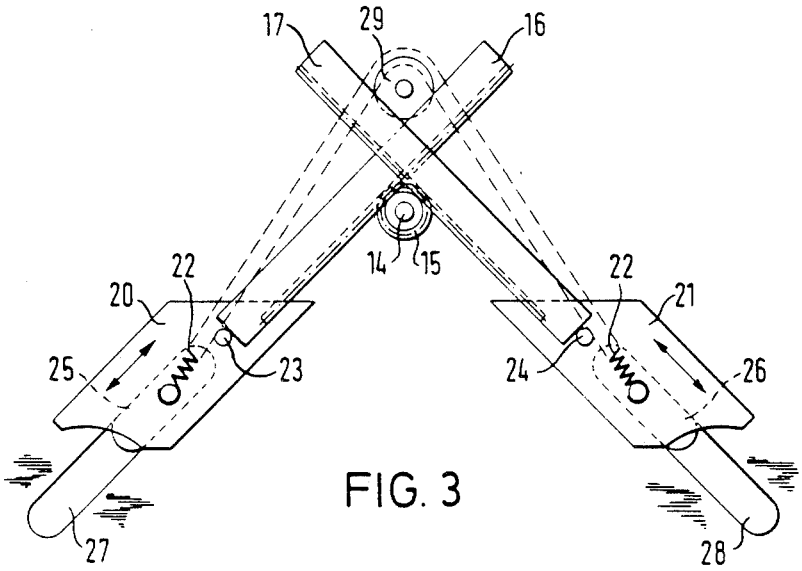
FIG. 3 is a plan view of the retractor elements with racks and pinion controlled by the stepping motor shown in their basic positions which correspond to the level-cams position; and, FIG. 4 is a plan view, similar to FIG. 3, but in which the right-hand, trailing retractor element has been moved into the retracted position during the reversal of movement of the carriage at the right-hand end of the machine and the left-hand, leading retractor element is in the basic position, whereby the device is set up for a traverse of the carriage from right to left.

As is shown in FIG. 3, the retractor elements 20 and 21 are mounted to be displaceable in grooved guides 27 and 28 in the directions shown by the double-headed arrows. The grooved guidance is effected by guide blocks 25 and 26 of the retractor elements 20 and 21 sliding in the guide grooves 27 and 28. FIG. 3 shows the basic position of the two retractor elements 20 and 21; this basic position corresponds in the practical embodiment of the device to the level-cams position. In this position the two racks 16 and 17 are set at the same level. The two retractor elements 20 and 21 are connected by means of a tension spring 22 which is tensioned by being passed around a guide roller 29, so that the two retractor elements 20 and 21 are drawn into contact with the racks 16 and 17 respectively. In the basis position, one end of each of the racks 16 and 17 is in contact with a stop 23 and 24 on the associated retractor element 20, 21. These stops 23 and 24 represent a sliding link between the retractor elements 20 and 21 and the associated racks 16 and 17.

In the basic position shown in FIG. 3 the guide blocks 25 and 26 of the retractor elements 20 and 21 are positioned at the upper limits of the guide grooves 27 and 28. This is the position in which the scale of the graduated ring 10 is set zero to zero with respect to a vernier scale 32, and in this position the pinion 15, which was previously slidable on the output end 14 of the shaft of the stepping motor 1, is clamped on to the shaft end 14 by means of its screw connection. In this position the switch finger 11 has one edge 30 thereof in alignment with an intercept point 31 of the position sensor 13.

Figure 4:
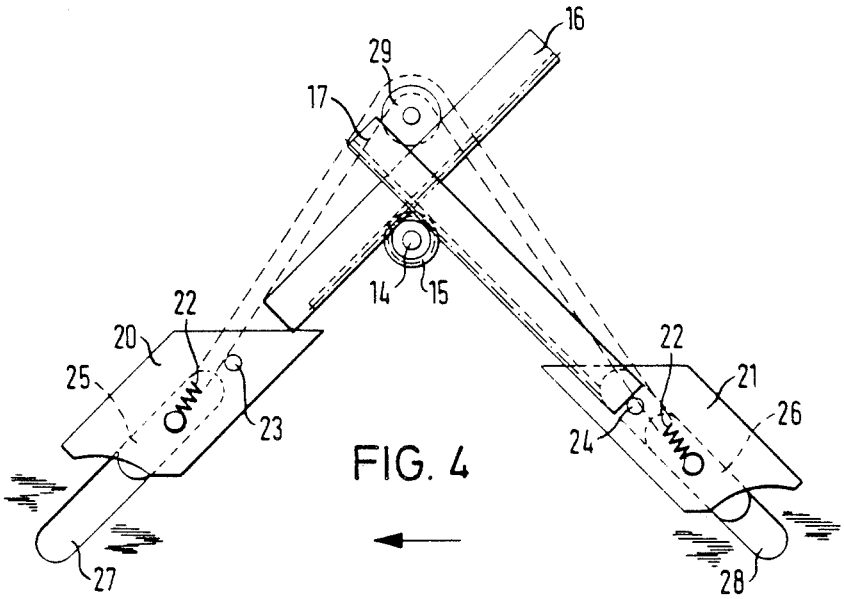

If now for example the right-hand retractor element 21, as it is shown in FIG. 4, for a carriage movement from right to left, is to take up a retracted position corresponding for example to a scale position 5 on the graduated ring 10, then the stepping motor 1, during the reversal of the carriage at the right-hand end of the machine, receives through the machine control system a command to rotate itself through a corresponding number of steps. Before this, the electromagnetic brake 3 has been energised with current, so that the disc 5 has been withdrawn and the braking disc 6 freed. There is therefore no longer any active connection between the brake 3 and the stationary sleeve 2, which means that the stepping motor 1 is then free to rotate. When the scale position 5 has been reached, the current supply to the brake 3 is switched off so that the compression springs 4 then urge the disc 5 and through it the braking disc against the sleeve 2. The tension setting according to FIG. 4 which has been achieved by this means is consequently held by the de-energised brake 3 which is without current.

The stepping motor 1 and all the components secured to the upper end 7 of its shaft have thus rotated to the new position. The graduated ring 10 then stands with its scale number 5 set against the vernier number 0. The retractor element 21 has been displaced downwardly by the rotation of the pinion 15 moving the rack 17 and the stop 24. The retractor element 20, which is positioned with its guide block 25 at the upper limit of the guide groove 27, remains in this position during this rotary movement, by virtue of the fact that the rack 16 has been freed from the stop 23 and has been moved upwards through the same distance that the other rack 17 has been displaced downwards. The tension spring 22 has therefore been put under tension, in order to bring the rack 16 into resilient contact again with the stop 23 for the contrary rotation of the pinion 15 during the next reversal of movement of the carriage, and consequently to produce the balance in relation to the other retractor element 20.

With each reversal of movement of the carriage the retractor elements 20, 21 and the switch finger 11 pass through the basic position as it is shown in FIGS. 2 and 3. The position sensor 13 is connected to an electronic circuit which monitors the basic position of the retractor elements 20 and 21 each time that the stepping motor 1 passes through the zero position, and, in the event of any deviation from the basic position due to a possible shifting of the stepping motor 1, switches off the knitting machine.

To summarise briefly therefore, with the tension adjusting device of the present invention, the retractor elements 20 and 21 both for the leftward and rightward travel of the carriage are connected to a single stepping motor 1. The retractor element which is the leading element at any given time no longer needs to be mechanically mounted for pendular movement, but with the adoption by the trailing retractor element of the retracted position moves automatically into the level-cams position, while the racks 16 and 17 are always displaced through the same distance. The position taken up by the stepping motor 1 is held by compression springs 4 of the electromagnetic brake 3, which itself is without current during the knitting process and is only energised with current for so long as the stepping motor 1 is functioning. The passage of the stepping motor 1 through the zero or null position, corresponding to the basic position (level-cams position) of the retractor elements 20 and 21 is established by the switch finger 11 of the inductive, capacitive or optical position sensor 13. The retracted position adopted by the trailing retractor element is monitored, during the reversal of the carriage, by the sweep movement of the switch finger 11 through the forked arms of the position sensor 13, and the detection of any error leads to the knitting machine being switched off.

We claim:

1. In a flat knitting machine having a reciprocable carriage incorporating cam systems comprising retractor elements for the needles, a tension adjusting device for adjusting the retractor elements to set the stitch tension, said device comprising, on the carriage, a single stepping motor for counterbalanced adjustment of the leading and of the trailing retractor element of each cam system, a position sensor on the stepping motor, pinion means connected for fixed rotation with the stepping motor, and two rack means, said pinion means being in counterbalanced meshing engagement with said two rack means, one of said rack means being connected to one of the retractor elements and the other rack means being connected to the other retractor element.

2. A tension adjusting device according to claim 1, in which the connection of the pinion means for fixed rotation with the stepping motor is a releasable connection.

3. A tension adjusting device according to claim 2, in which the retractor elements are mounted on the carriage by means of guide grooves and guide blocks with an upper stop position for the basic position of each retractor element, and in which the rack means are releasably linked to the retractor elements by means of stops on the retractor elements.

4. A tension adjusting device according to claim 3, in which the retractor elements are resiliently connected to each other by a tension spring means which extends around a guide roller.

5. A tension adjusting device according to claim 1, in which the stepping motor includes an electromagnetic brake which is constructed in such a way that the output-side end of the shaft of the stepping motor is held braked in its then adopted position when the brake is without energising current.

6. A tension adjusting device according to claim 1, in which the stepping motor is provided with an annular scale connected to a switch finger of its position sensor.

7. A tension adjusting device according to claim 6, in which the annular scale is a vernier scale.

8. A tension adjusting device according to claim 1, in which the position sensor is an inductive sensor.

9. A tension adjusting device according to claim 1, in which the position sensor is a capacitive sensor.

10. A tension adjusting device according to claim 1, in which the position sensor is an optical sensor.

11. A tension adjusting device according to claim 1, in which the position sensor is connected to an electronic circuit which monitors the basic position of the retractor elements for each pass of the stepping motor through its zero position and which switches off the knitting machine in the event of a departure from the basic position.

* * * * *

UNITED STATES PATENT AND TRADEMARK OFFICE

CERTIFICATE OF CORRECTION

PATENT NO. : 4,502,300

DATED : March 5, 1985

INVENTOR(S) : Reinhold SCHIMKO, Franz RADL, and Max FUCHS

It is certified that error appears in the above-identified patent and that said Letters Patent is hereby corrected as shown below:

Title page:

[30] Foreign Application Priority Data

December 7, 1982 Germany . . . . . 32 45 230

Signed and Sealed this

Fourth Day of November, 1986

[SEAL]

*Attest:*

DONALD J. QUIGG

*Attesting Officer*

*Commissioner of Patents and Trademarks*